US010571844B2

(12) United States Patent
Uekawa et al.

(10) Patent No.: US 10,571,844 B2
(45) Date of Patent: Feb. 25, 2020

(54) IMAGE FORMING APPARATUS THAT CONTROLS A DEGREE OF TEMPERATURE RISE OF A ROTATABLE MEMBER OF A FIXING PORTION

(71) Applicant: CANON KABUSHIKI KAISHA, Tokyo (JP)

(72) Inventors: Eiji Uekawa, Susono (JP); Takao Izaki, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/218,946

(22) Filed: Dec. 13, 2018

(65) Prior Publication Data

US 2019/0187597 A1 Jun. 20, 2019

(30) Foreign Application Priority Data

Dec. 15, 2017 (JP) ..... 2017-240502
Oct. 16, 2018 (JP) ..... 2018-194828

(51) Int. Cl.
*G03G 15/00* (2006.01)
*G03G 15/20* (2006.01)

(52) U.S. Cl.
CPC ..... *G03G 15/505* (2013.01); *G03G 15/2017* (2013.01); *G03G 15/2039* (2013.01); *G03G 15/5008* (2013.01)

(58) Field of Classification Search
CPC ..... G03G 15/505; G03G 15/2017; G03G 15/2039; G03G 15/205; G03G 15/5008
See application file for complete search history.

(56) References Cited

U.S. PATENT DOCUMENTS 6,493,521 B2 12/2002 Miyamoto et al.
9,261,826 B2 2/2016 Kataoka et al.
2004/0218943 A1* 11/2004 Hirai ..... G03G 15/2039 399/69
2012/0148290 A1* 6/2012 Asami ..... G03G 15/2042 399/92

(Continued)

FOREIGN PATENT DOCUMENTS

JP 2001-222183 A 8/2001
JP 2005-202174 A 7/2005
JP 2008-089973 A 4/2008

(Continued)

*Primary Examiner* — Sandra Brase
(74) *Attorney, Agent, or Firm* — Venable LLP

(57) ABSTRACT

An image forming apparatus includes an image forming portion configured to form an image on a recording material, and a fixing portion including a first rotatable member and a second rotatable member, rotatable by rotation of the first rotatable member, and in contact with the first rotatable member. The fixing portion fixes the image on the recording material by heating the image while nipping and feeding the recording material, on which the image is formed, at a nip formed between the first rotatable member and the second rotatable member. A motor drives the first rotatable member, and torque detecting means detects a driving torque of the motor. On the basis of the driving torque detected by the torque detecting means, a controller controls a degree of temperature rise of the first rotatable member immediately before the recording material enters the nip.

18 Claims, 13 Drawing Sheets

(56) References Cited

U.S. PATENT DOCUMENTS

| | | | | |
|---|---|---|---|---|
| 2012/0328323 | A1* | 12/2012 | Murooka ..... | G03G 15/2017<br>399/92 |
| 2015/0346660 | A1 | 12/2015 | Usui et al. | |

FOREIGN PATENT DOCUMENTS

| | | | |
|---|---|---|---|
| JP | 2015-227983 | A | 12/2015 |
| JP | 2016-021054 | A | 2/2016 |

* cited by examiner

IMAGE FORMING APPARATUS THAT CONTROLS A DEGREE OF TEMPERATURE RISE OF A ROTATABLE MEMBER OF A FIXING PORTION

This application claims the benefit of Japanese Patent Application No. 2017-240502, filed on Dec. 15, 2017, and Japanese Patent Application No. 2018-194828, filed on Oct. 16, 2018, which are hereby incorporated by reference herein in their entirety.

FIELD OF THE INVENTION AND RELATED ART

The present invention relates to an image forming apparatus, such as an electrophotographic copying machine or an electrophotographic printer.

As a fixing device mounted on the electrophotographic copying machine or printer, a film heating type fixing device has been known. The fixing device of this type includes a heater, a cylindrical film rotatable while contacting the heater at an inner peripheral surface thereof, a pressing roller for forming a nip with the film contacting the heater, and a motor for rotating the pressing roller. The film rotates while following rotation of the pressing roller. A recording material, carrying an unfixed toner image, is heated at the nip while being nipped and fed, whereby the toner image is fixed on the recording material.

In the fixing device of the film heating type, although the film and the heater each have a small thermal capacity and are warmed quickly, the pressing roller has large thermal capacity and is not readily warmed. Accordingly, a phenomenon occurs in which water vapor, which generates from the recording material in a process in which the recording material is heated while being nipped and fed through the nip, condenses (forms dew) on an outer peripheral surface of the pressing roller and a frictional force between a surface of the pressing roller and the outer peripheral surface of the film lowers, and thus the film cannot be rotated. Hereafter, this phenomenon is referred to as a dew condensation slip.

In a state in which rotation of the film is decelerated or stopped, it becomes difficult to feed the recording material, so that the recording material is loosened in front of a fixing nip. Then, there is a possibility that a printed surface of the recording material is rubbed with a member provided on an entrance side of the fixing device and thus, an image defect occurs or a jam occurs in the fixing device.

As regards the dew condensation slip, an amount of the water vapor forming dew on the surface of the pressing roller increases with a lower surface temperature of the pressing roller, so that the image defect or the jam is liable to occur. With speed-up of the image forming apparatus, the number of sheets per unit hour of recording materials passing through the nip increases, and, therefore, the surface temperature of the pressing roller during continuous printing is not readily made greater than that in a conventional constitution.

Therefore, in order to avoid the dew condensation slip, as disclosed in Japanese Laid-Open Patent Application No. 2001-222183, a method in which times of rotation of the pressing roller and the film, performed before a start of a fixing process of the fixing device, are extended and thus, the surface of the pressing roller is warmed is effective. Japanese Laid-Open Patent Application No. 2015-227983 discloses a method in which a film traveling state immediately after the recording material passes through the nip is detected and then, feeding timing of a subsequent recording material is determined. Specifically, when the rotation of the film is decelerated or stopped, the film traveling state is discriminated from an ascending amount or a descending amount of a detection temperature using a detection result of a temperature detecting means for detecting a temperature of either of the heater or the film.

In the above-described image forming apparatus, it has been required that a degree of an occurrence of the dew condensation slip of the film of the fixing device is effectively reduced without providing a user with an unnecessary stand-by time.

SUMMARY OF THE INVENTION

A principal object of the present invention is to provide an image forming apparatus capable of reducing a degree of a slip occurring on a rotatable member that rotates while following another rotatable member, which is rotated by a motor of a fixing portion, without providing a user with an unnecessary stand-by time.

According to one aspect, the present invention provides an image forming apparatus comprising an image forming portion configured to form an image on a recording material, a fixing portion including a first rotatable member and a second rotatable member rotatable by rotation of the first rotatable member and in contact with the first rotatable member, the fixing portion being configured to fix the image on the recording material by heating the image while nipping and feeding the recording material on which the image is formed, at a nip formed between the first rotatable member and the second rotatable member, a motor configured to drive the first rotatable member, torque detecting means configured to detect a driving torque of the motor, and control means, wherein, on the basis of the driving torque detected by the torque detecting means, the control means controls a degree of temperature rise of the first rotatable member immediately before the recording material enters the nip.

Further features of the present invention will become apparent from the following description of exemplary embodiments with reference to the attached drawings.

DESCRIPTION OF EMBODIMENTS

Embodiments of the present invention will be described with reference to the drawings. Although these embodiments are preferred embodiments of the present invention, the present invention is not limited to the following embodiments, and constitutions thereof can be replaced with other various constitutions within a scope of a concept of the present invention.

Embodiment 1

(1) Image Forming Apparatus 100

Figure 1:
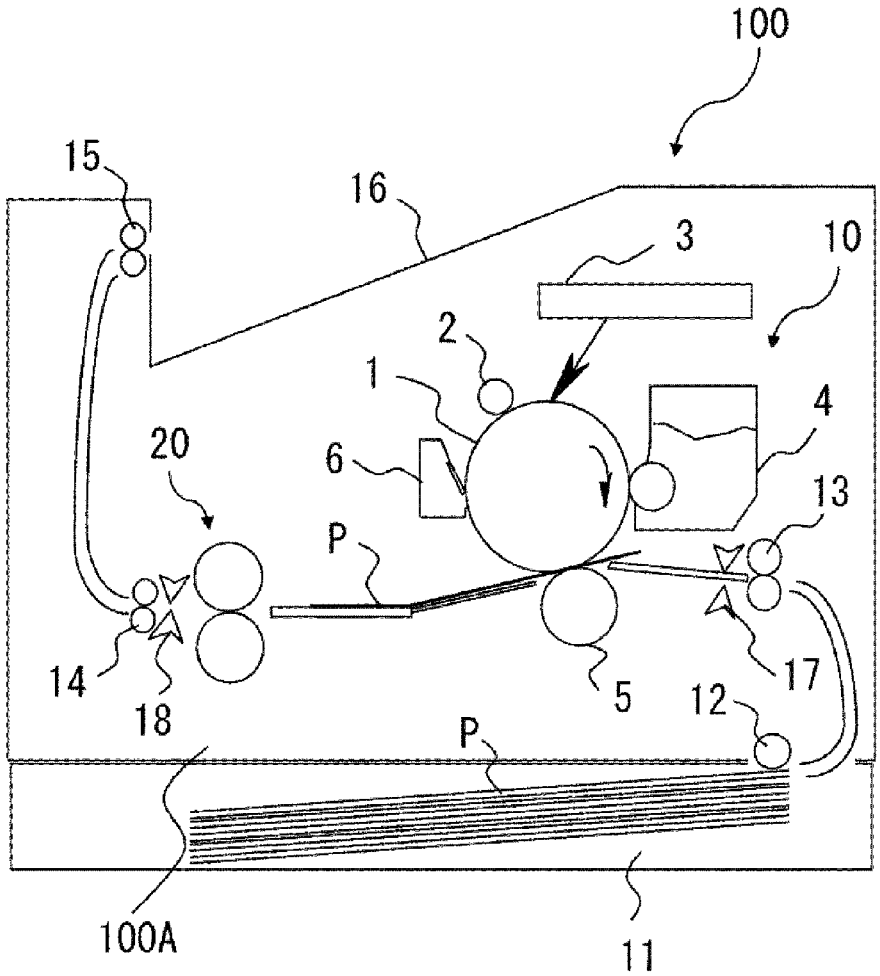
FIG. 1 is a sectional view showing a general structure of an image forming apparatus according to Embodiment 1.

With reference to FIG. 1, an image forming apparatus 100 according to this embodiment will be described. FIG. 1 is a sectional view showing a general structure of an example of the image forming apparatus (a monochromatic layer printer in this embodiment) 100 using an electrophotographic recording technique.

In the image forming apparatus 100, an image forming portion 10, for forming an image on a recording material, includes a photosensitive drum 1 as an image bearing member, a charging member 2, a laser scanner 3, a developing device 4, a transfer member 5, and a cleaner 6 for cleaning an outer peripheral surface of the photosensitive drum 1. An operation of the image forming portion 10 is well known and will be omitted from this detailed description.

Recording materials P, accommodated in a cassette 11, as an accommodating portion in an apparatus main assembly 100A, are fed one by one by rotation of a roller 12, and each recording material P is fed by rotation of a roller pair 13 to a transfer portion formed between the photosensitive drum 1 and the transfer member 5. The recording material P, on which a toner image is transferred at the transfer portion, is sent to a fixing device 20 as a fixing portion, and an unfixed toner image is heat-fixed on the recording material P by the fixing device 20. The recording material P coming out of the fixing device 20 is discharged onto a tray 16 by rotation of rollers 14 and 15.

A top sensor 17 detects a leading end of the recording material P with respect to a recording material feeding direction, and thus, adjusts feeding timing of the recording material P to the transfer portion by the feeding roller 13 so that an image forming position of the toner image on the surface of the photosensitive drum 1 and a writing position of the leading end of the recording material P coincide with each other. A discharge sensor 18 is a sensor for detecting a jam of the recording material P when the jam occurs between itself and the top sensor 17.

(2) Fixing Device (Fixing Portion) 20

Figure 2:
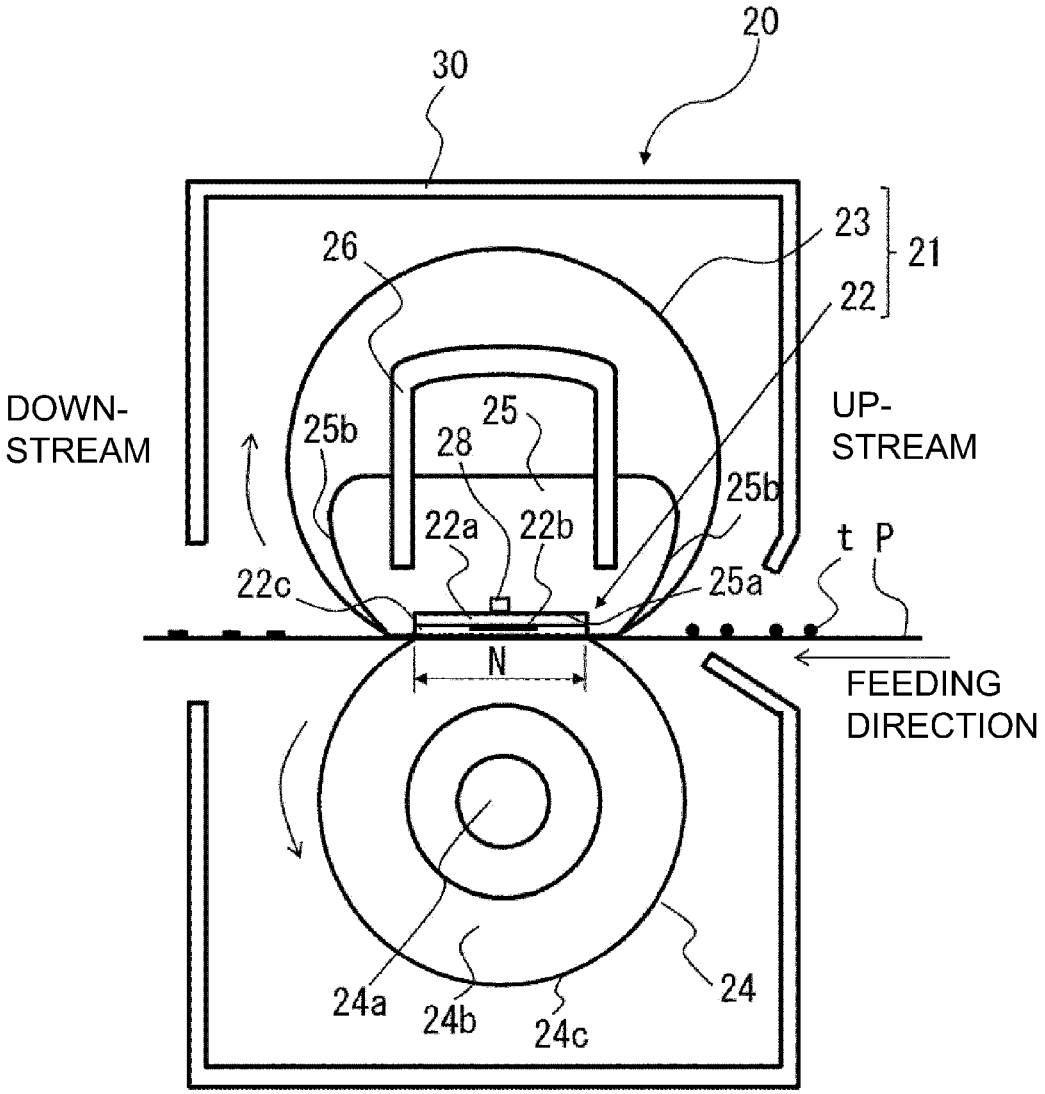
FIG. 2 is a sectional view showing a general structure of a fixing device.
Figure 3:
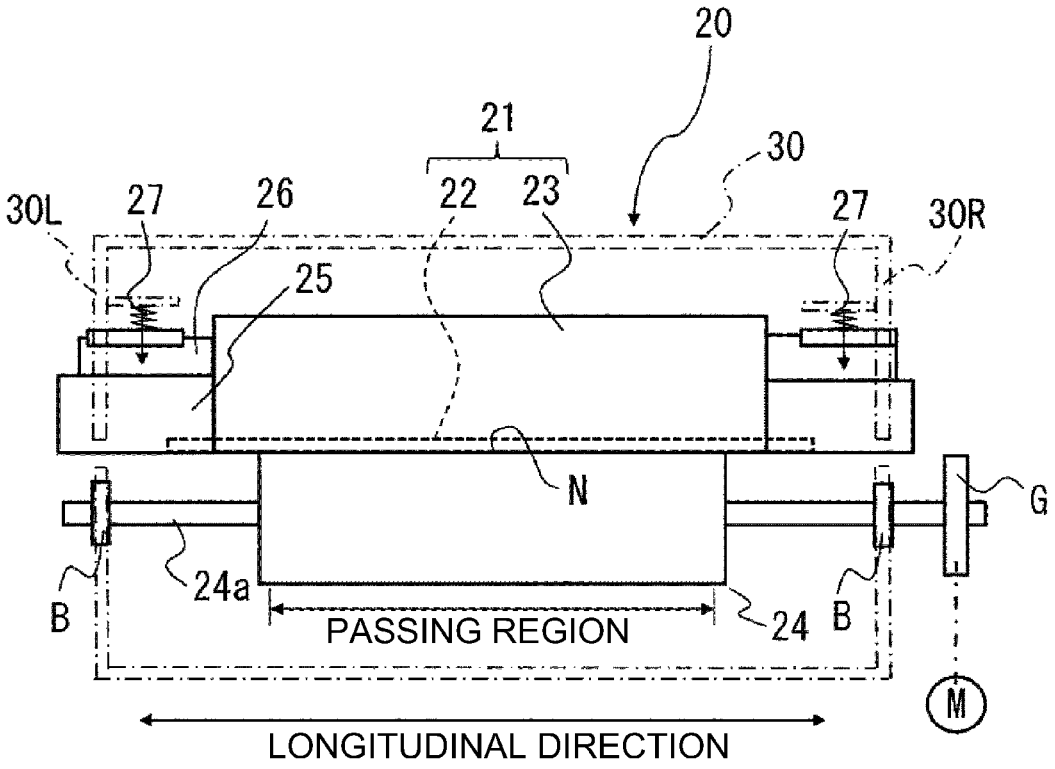
FIG. 3 is a schematic view of the fixing device as seen from an upstream side of a recording material feeding direction.

The fixing device 20 in this embodiment is a fixing device of a film heating type. The fixing device 20 will be described with reference to FIGS. 2 and 3. FIG. 2 is a sectional view showing a general structure of the fixing device 20. FIG. 3 is a schematic view of the fixing device 20 as seen from an upstream side of the recording material feeding direction.

In the fixing device 20, a heating unit 21 includes a plate-like ceramic heater 22 as a heating member, and a cylindrical film (second rotatable member) 23. A pressing roller (first rotatable member) 24 contacts the film 23 and forms a nip N between itself and the film 23. The fixing device 20 further includes a guiding member 25 and a metal stay 26 for reinforcing the guiding member 25.

The guiding member 25 for guiding rotation of the film 23 supports the heater 23 by a groove 25*a* provided at a central portion of a flat surface thereof. The guiding member 25 is formed of a heat-resistant resin material, such as a liquid crystal polymer, a phenolic resin, polyphenylene sulfide (PPS), or polyether ether ketone (PEEK), and guides the rotation of the film 23 by a guiding surface 25*b* provided on upstream and downstream sides with respect to the recording material feeding direction. On a flat surface of the guiding member 25 opposite from the groove 25*a* side, the stay 26 is provided. The guiding member 25, which supports the heater 22 and on which the stay 26 is provided, is inserted into a hollow portion of the film 23.

The heater 22 includes an elongated substrate 22*a* extending in a longitudinal direction of the fixing device 20 perpendicular to the recording material feeding direction. On a surface of the substrate 22*a*, formed of alumina or aluminum nitride, on the pressing roller 24 side, a heat generating resistance layer 22*b* of silver palladium (Ag/Pd), ruthenium oxide ($RuO_2$), tantalum nitride ($Ta_2N$), or the like, is formed along the longitudinal direction of the heater 22. On the surface of the substrate 22*a* on the pressing roller 24 side, a glass layer is further formed as a protective layer 22*c* for protecting the heat generating resistance layer 22*b* within a range not impairing thermal efficiency.

The film 23 is a heat-resistant film having a total thickness of 500 μm or less for enabling a quick start. This film 23 includes a cylindrical base layer and a surface layer provided on an outer peripheral surface of the base layer. As a material of the base layer, it is possible to use an electroconductive resin material in which electroconductive fine particles of carbon black, or the like, are added into a heat-resistant resin, such as polyimide, polyamideimide, or PEEK. Or, as the material of the base layer, it is possible to use electroconductive metal using a metal, such as stainless use steel (SUS), aluminum (Al), nickel (Ni), copper (Cu), or zinc (Zn), having a heat-resistant property and a high thermoconductivity, or an alloy of the metal. Further, in order to constitute the fixing device 20 having a long lifetime (durable lifetime), as a thickness of the base layer having sufficient strength and excellent durability, 20 μm or more and 200 μm or less are suitable.

As a material of the surface layer, in order to ensure an offset preventing property and a recording material separating property, it is possible to use a fluorine-containing resin material, such as polytetrafluoroethylene (PTFE), tetrafluoroethylene-perfluoroalkylvinyl ether copolymer, (PFA), tetrafluoroethylene-hexafluoropropylene copolymer (FEP), ethylenetetrafluoroethylene copolymer (ETFE), polychlorotrifluoroethylene (CTFE), or polyvinylidene difluoride (PVDF). Or, as the surface layer, a base layer coated at its outer peripheral surface with a heat-resistant resin material having a good parting property, such as silicone resin, or the like, in mixture or singly, may also be used.

A silicone rubber layer having a thickness of about 100 μm to 300 μm may also be provided as an intermediary rubber layer between the surface layer and the base layer. By providing the intermediary rubber layer, the surface of the film 23 easily follows unevenness of the surface of the recording material P and unevenness of the toner image, so that it is possible to obtain a toner image having a good image quality.

The pressing roller 24 includes a metal core 24*a* made of metal, such as SUS (steel use stainless) or SUM (steel use machinability), an elastic layer 24*b* provided on an outer peripheral surface of the metal core 24*a*, and a surface layer 24*c* provided on an outer peripheral surface of the elastic layer 24*b*.

As a material of the elastic layer 24*b*, an elastic solid rubber layer formed of a heat-resistant rubber, such as a silicone rubber or a fluorine-containing rubber, can be used. Or, as the material of the elastic layer 24*b*, a sponge rubber layer formed by foaming a silicone rubber in order to further achieve a heat-insulating effect can be used. Or, as the material of the elastic layer 24*b*, it is possible to use a foam rubber layer enhanced in a heat-insulating effect by forming a gas portion in a cured material by dispersing hollow fillers (microballoons, or the like) in the silicone rubber layer. In the elastic layer 24*b*, electroconductive particles, such as carbon black, are added, so that electroconductivity is imparted.

These elastic layers may be a single layer and may also be formed by laminating a plurality of layers, different in property depending on the purpose, such as thermal conductivity or hardness adjustment. As a material of the surface layer 24*c*, PFA or PTFE can be used.

As shown in FIG. 3, with respect to the longitudinal direction, both end portions of the metal core 24*a* of the pressing roller 24 are rotatably supported by left and right side plates 30L and 30R of a frame 30 of the fixing device 20 through bearings B. Further, both end portions of the guiding member 25 and the stay 26 are supported by the left and right side plates 30L and 30R.

Both end portions of the stay 26 are pressed (urged) in an arrow direction by pressing (urging) springs 27, and by pressing forces (pressures) of the pressing springs 27, the guiding member 25 presses the heater 22. As a result, the elastic layer 24*b* of the pressing roller 24 is elastically deformed, so that the nip N is formed between the pressing roller 24 surface and the film 23 surface.

Heat-Fixing (Process) Operation

When a motor M is rotated by a motor driving circuit portion 41 (FIG. 5), rotation of the motor M is transmitted to a gear G (FIG. 3) provided at one end portion of the metal core 24*a* of the pressing roller 24, whereby the pressing roller 24 is rotated in an arrow direction shown in FIG. 2. The film 23 is rotated in an arrow direction shown in FIG. 2 by the rotation of the pressing roller 24 while an inner surface thereof slides with the protective layer 22*c* of the heater 22. Between the inner surface of the film 23 and the protective layer 22*c* of the heater 22, a lubricant, such as heat-resistant grease of a fluorine type or a silicone type, is interposed. As a result, a frictional resistance between the inner surface of the film 23 and the protective layer 22*c* can be reduced, so that the film 23 becomes smoothly rotatable.

When electrical power is supplied from a power source (not shown) to the heat generating resistance layer 22*b* of the heater 22, the heat generating resistance layer 22*b* generates heat, so that the heater 22 abruptly increases in temperature. An energization control circuit (not shown) controls electrical power supplied to the heater 22 so that the temperature of the heater 22 is maintained at a predetermined fixing temperature (target temperature), on the basis of a detection temperature of the heater 22 detected by a thermistor 28 (FIG. 2) as a temperature detecting means supported by the guiding member 25.

The recording material P carrying an unfixed toner image t is heated in the nip N while being nipped and fed through the nip N, whereby the toner image is fixed on the recording material P.

Occurrence Factor of Dew Condensation Slip

The dew condensation slip occurs by dew condensation, on the surface of the pressing roller 24, of water vapor generated from the recording material P when the recording material P passes through the nip N. In a case in which the number of printed sheets is 1, even when the water vapor condenses on the surface of the pressing roller 24, a subsequent recording material is not fed to the nip N and, therefore, there is no problem.

Figure 4A:
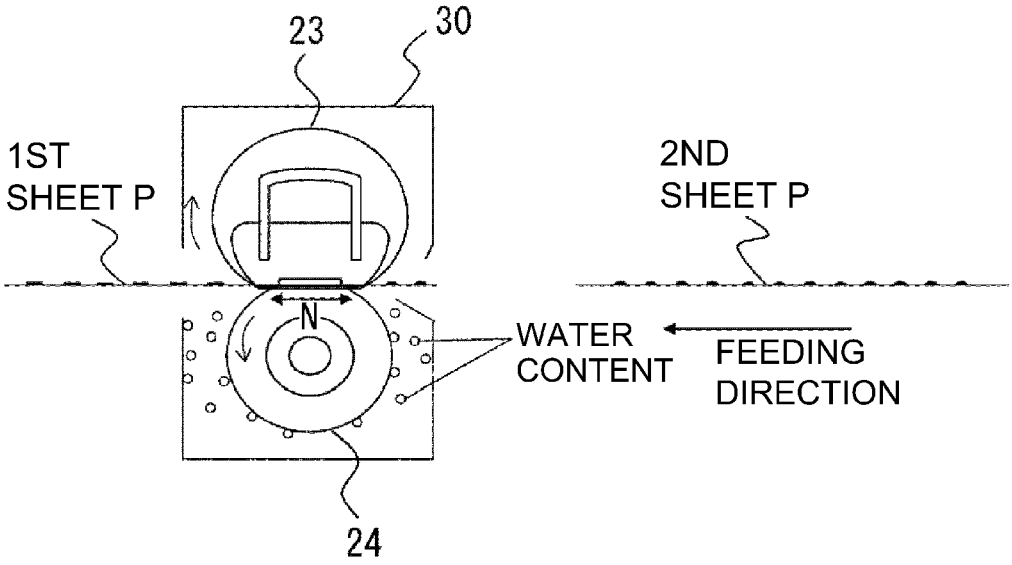
FIGS. 4A to 4D are schematic views for illustrating an occurrence factor of a dew condensation slip.

This will be described specifically using FIGS. 4A to 4D. FIG. 4A shows an image when a first recording material (sheet) P passes through the nip N in a case in which images are formed on a plurality of recording materials (sheets) P. The water vapor is emitted by the first recording material P, so that an amount of water content in an atmosphere around the pressing roller 24 increases.

Figure 4B:
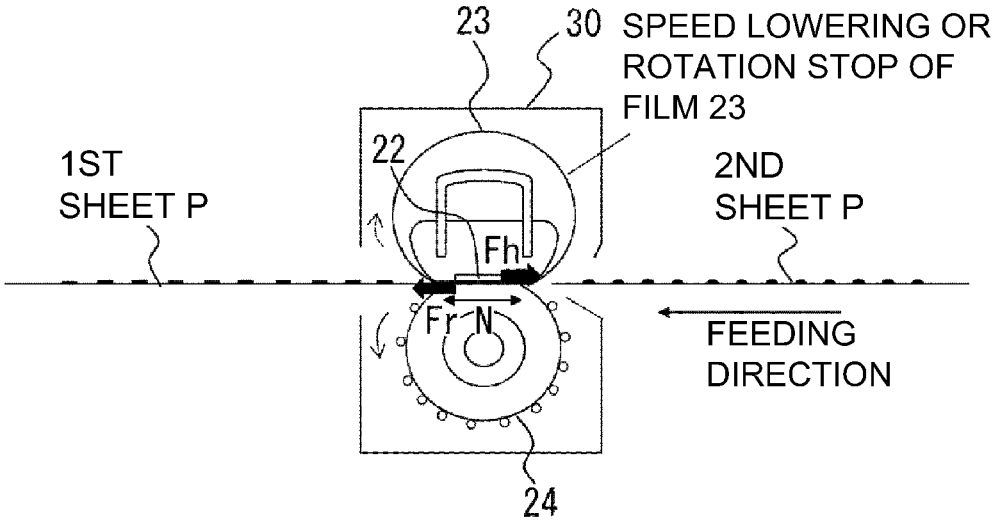

FIG. 4B shows a state in which the water content in the atmosphere around the pressing roller 24 condenses on the pressing roller surface between the first recording material P and a second recording material P. Here, in the nip N, a force (feeding force) for feeding the film 23 by the pressing roller 24 through a frictional force between the pressing roller 24 surface and the film 23 surface is Fr, and a sliding resistance force acting on the protective layer 22*c* of the heater 22 and the inner surface of the film 23 is Fh. When the dew condensation does not generate on the surface of the pressing roller 24 and the above-described frictional force sufficiently acts, a relationship of Fr>Fh holds. Fr decreases, however, with an increasing amount of dew condensation generating on the surface of the pressing roller 24, and then, a rotational speed of the film 23 lowers or rotation of the film 23 stops, so that a slip occurs on the film 23.

Figure 4C:
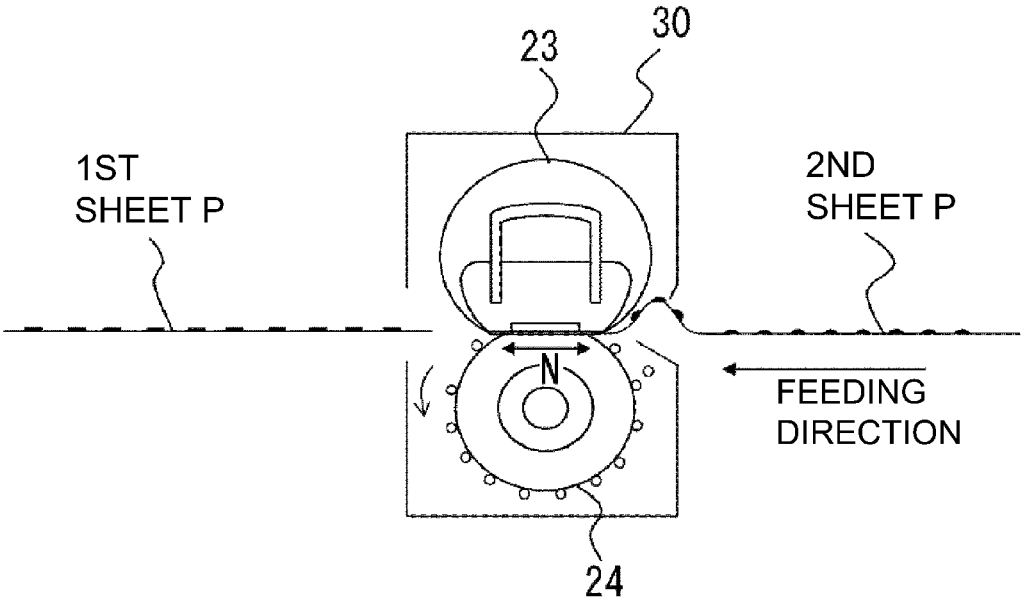
Figure 4D:
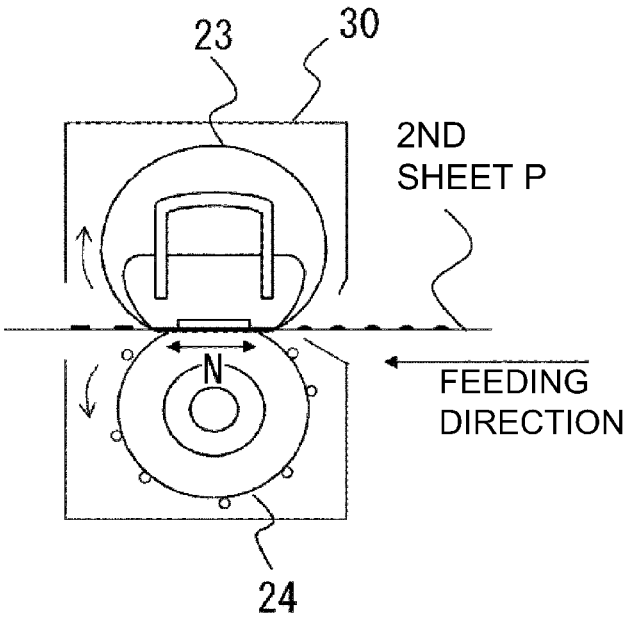

FIG. 4C shows a state in the case in which the slip occurs on the film 23, a leading end of the second recording material P does not enter the nip N, and loosening of the second recording material P occurs. With a lapse of a time from the generation of the slip, when the dew condensation on the pressing roller surface gradually disappears due to a temperature rise of the surface of the pressing roller 24 and a lowering of a humidity in the atmosphere around the pressing roller 24, the force Fr is restored, so that rotation of the film 23 returns to a normal rotation. As a result, the second recording material P is nipped and fed through the nip N as shown in FIG. 4D.

When the amount of the dew condensation in FIG. 4B increases, however, the rotation of the film 23 stops over a long temperature, and, therefore, a degree of the loosening of the recording material P increases and thus, a printed surface of the recording material P rubs against the frame 30 on a recording material entrance side, so that an image defect occurs. Or, a jam occurs at an upstream end of the nip N with respect to the recording material feeding direction, so that detection that the subsequent recording material is not fed is made by the discharge sensor 18 (FIG. 1).

The occurrence factor of the dew condensation slip is as described above, but as a condition having the influence on occurrence or non-occurrence of a slip including the dew condensation slip, there are conditions described below.

First, in a case in which the amount of the water content contained in the recording material P is large, an amount of water vapor generating during passing of the recording material P through the nip N becomes large, so that the dew condensation is liable to occur on the surface of the pressing roller 24. In a case in which the image forming apparatus 100 includes a humidity sensor capable of detecting a humidity in the atmosphere around the pressing roller 24, it is possible to predict the occurrence of the dew condensation on the surface of the pressing roller 24 from a detection result of the humidity sensor.

Next, as regards a kind of the recording material P, a recording material such as thin paper, which is weak (low) in rigidity or stiffness, is liable to slacken (loosen) at the instant when the recording material enters the nip N, and, therefore, the image defect and the jam are liable to occur. On the other hand, thick paper, or the like, having high rigidity, does not readily cause the slip by a feeding force receiving from the pressing roller 24 and by the action of stiffness of the recording material itself.

Further, as regards an image pattern of the unfixed toner image t to be formed on the recording material P, the slip is liable to occur for an image with a high print ratio, such as a solid image or a halftone image. In the case of one-side printing, on a surface of the recording material P contacting the film 23, the toner image t exists, and, therefore, water vapor is liable to be blocked by the toner image t. On the other hand, on a surface of the recording material P contacting the pressing roller 24, the toner image t blocking emission of the water vapor does not exist. For this reason, the water vapor tends to be emitted from the surface of the recording material P contacting the pressing roller 24 than from the surface of the recording material P contacting the film 23. This is because when the print ratio is greater, this tendency becomes stronger, and water vapor is liable to be emitted toward the pressing roller 24 side and thus, an ambient humidity around the pressing roller 24 is more enhanced.

Further, an occurrence rate changes depending on an accumulated (cumulative) use amount of the fixing device 20. The slip does not readily occur in a fixing device 20 in a brand-new state. With use of the device 20, the surface of the pressing roller 24 or the surface of the film 23 is deteriorated due to abrasion (wearing), and a frictional force between the pressing roller surface and the film surface lowers, so that the slip is liable to occur.

Further, also by deterioration of the lubricant, such as grease, provided between the inner surface of the film 23 and the protective layer 22*c* of the heater 22 for the purpose of improving a sliding property, the force Fh increases, so that the slip is liable to occur.

The dew condensation slip occurs due to a combination of various conditions described above, and, therefore, depending on a using state of the image forming apparatus 100 by a user, occurrence or non-occurrence of the dew condensation slip and a manner of occurrence of the dew condensation slip vary. Therefore, if a sign of the occurrence of the dew condensation slip can be detected, countermeasures for properly avoiding the occurrence of the dew condensation slip are easily taken. In the following, a method thereof will be described.

Sign Detection of Dew Condensation Slip

As regards a phenomenon that a traveling state (rotational state) of the film 23 is unstabilized by dew condensation occurring on the surface of the pressing roller 24, the present inventors have found that sign detection of the dew condensation slip is capable of being performed. That is, the sign detection of the dew condensation slip can be performed by detecting a current supplied to the motor M and then by using a q-axis current, which is a torque component current, after the following two processes are carried out. Here, the two processes are a UVW/αβ coordinate transformation process and an aβ/dq coordinate transformation process.

Figure 5:
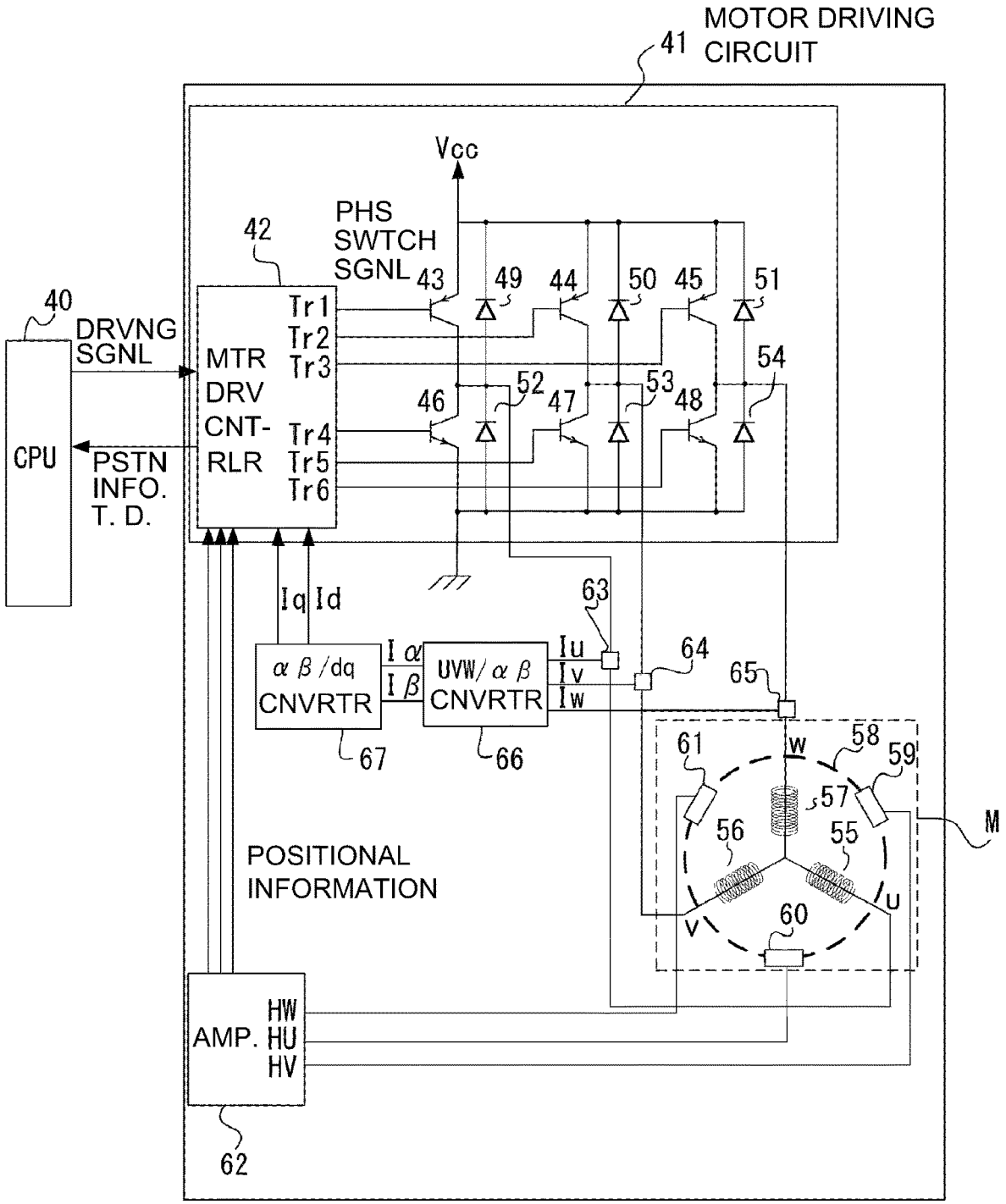
FIG. 5 is a block diagram showing a relationship among a motor, a motor driving circuit portion, a UVW/αβ, a UVW/αβ coordinate transformation portion, an aβ/dq coordinate transformation portion, an amplifier, and a central processing unit (CPU).

First, a method of acquiring the q-axis current will be described with reference to FIG. 5. FIG. 5 is a block diagram showing a relationship among a motor M, the member drive circuit portion 41, a UVW/αβ coordinate transformation portion 66, an aβ/dq coordinate transformation portion 67, an amplifier 62, and a central processing unit (CPU) (control means) 40.

In this embodiment, as the motor M, a direct current (DC) brushless motor is used. This motor M includes a plurality of (different) phase coils 55, 56, and 57, which are connected with each other in a Y connection manner, and a rotor 58. The motor M further includes Hall elements 59, 60 and 61 as position detecting means for the rotor 58.

The Hall elements 59, 60 and 61 are elements by which magnetic flux is detected and a voltage generates between both terminals of a semiconductor chip, and are capable of detecting a position of the rotor 58 by detecting a change in magnetic flux by the rotor 58. Outputs of the Hall elements 59, 60 and 61 are amplified by the amplifier 62 and are input as positional information to a motor drive control circuit 42 of the motor drive circuit portion 41.

In this embodiment, the position of the rotor 58 is detected using the Hall elements 59, 60, and 61, but positional information acquired by calculation from currents flowing through the coils 55, 56, and 57. Thus, by simplification, it is possible to employ a constitution advantageous in cost reduction and downsizing of the device.

The motor drive circuit portion 41, for rotationally driving the rotor 58 by causing the currents to flow through the plurality of phase coils 55, 56, and 57, includes the motor drive control circuit 42, high-side transistors 43, 44, and 45, low-side transistors 46, 47, and 48, and diodes 49, 50, 51, 52, 53, and 54. The respective transistors 43 to 48 are connected with U, V, and W, which are both terminals of the coils 55, 56, and 57. Then, the respective transistors 43 to 48 rotate the rotor 58 by successively switching a phase to be excited under ON/OFF control in accordance with a phase-switching signal outputted from the motor drive control circuit 42.

Current detectors 63, 64, and 65 as current detecting means measure currents Iu, Iv, and Iw, respectively, supplied from the motor drive circuit portion 41 to the motor M. Output currents detected by the current detectors 63, 64, and 65 are converted (transformed) to a two-phase current (represented by a vector) on a rotating coordinate system by the UVW/αβ coordinate transformation portion 66 and the aβ/dq coordinate transformation portion 67, which are used as vector calculating means.

The UVW/αβ coordinate transformation is a process in which coordinates represented by three axes Iu, Iv, and Iw, detected by the current detectors 63, 64, and 65, respectively, are transformed to two axes Iα and Iβ. The aβ/dq coordinate transformation is a process in which the α, β coordinate system is coordinate-transformed to a d, q coordinate system, which is a virtual rotating coordinate system represented by a d-axis, which is a direction of magnetic flux generated by the rotor 58, and a q-axis perpendicular to the d-axis. By performing such coordinate transformation, it is possible to acquire a d-axis current Id, which is a current (energization component current) representing the magnetic flux, and a q-axis current Iq, which is a current (torque component current) representing a driving torque.

The acquired currents Id and Iq are output as current value information to the motor drive control circuit 42. The motor drive control circuit 42 detects not only a direction D of the magnetic flux of the motor M on the basis of Id, but also a driving torque T of the motor M on the basis of Iq. Then, the motor drive control circuit 42 outputs the detected driving torque T and the detected magnetic flux direction D together with the positional information to the CPU 40. On the basis of these pieces of information, a driving signal is output from the CPU 40 to the motor drive control circuit 42, so that the motor M is rotated.

The driving torque T of the motor M acquired using the above-described motor drive control circuit 42 has sufficient detection accuracy against a torque fluctuation, such that the dew condensation occurs. As regards a slip of the film 23 occurring between a (preceding) recording material and a subsequent recording material (between two consecutive recording materials) when images are printed on a plurality of recording materials P, there is a need to grasp a high-speed change in Iq on the order of 10 ms, as described later. From a viewpoint of responsiveness such that an instantaneous load fluctuation on the order of 10 ms can be grasped, the motor drive control circuit 42 is suitable for a torque detecting means for detecting the driving torque T of the motor M.

Further, rotation accuracy of the motor M controlled by the motor drive control circuit 42 also has a feature such that rotation non-uniformity is less than rotation non-uniformity in a conventional driving type. When the motor M having high rotation accuracy is used, non-uniformity and noise of the signal added to the current detectors 63, 64, and 65 also decrease. Therefore, the motor M controlled by the motor drive control circuit 42 is suitable for detection of the torque fluctuation of the motor M, and is suitable for detection of the dew condensation slip.

Next, behavior of Iq of the motor M during a printing operation in the image forming apparatus 100 will be described with reference to FIGS. 6A to 6C.

Figure 6A:
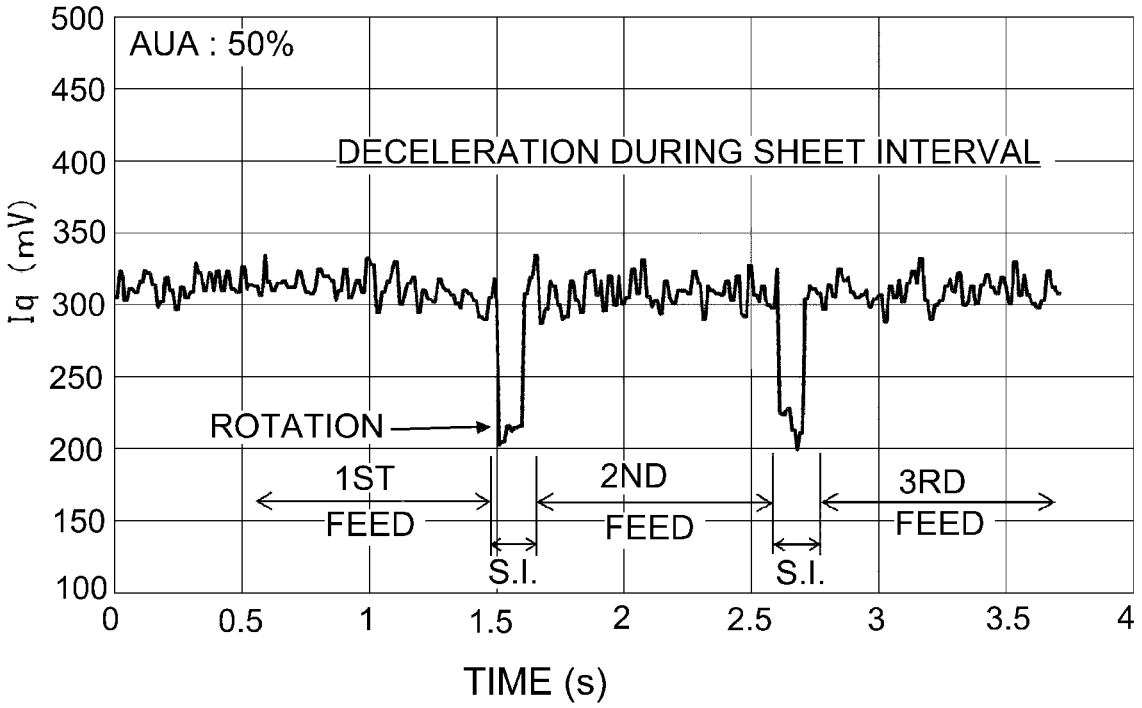
FIGS. 6A to 6C are schematic views each illustrating a relationship between a driving torque of the motor and the dew condensation slip.
Figure 6B:
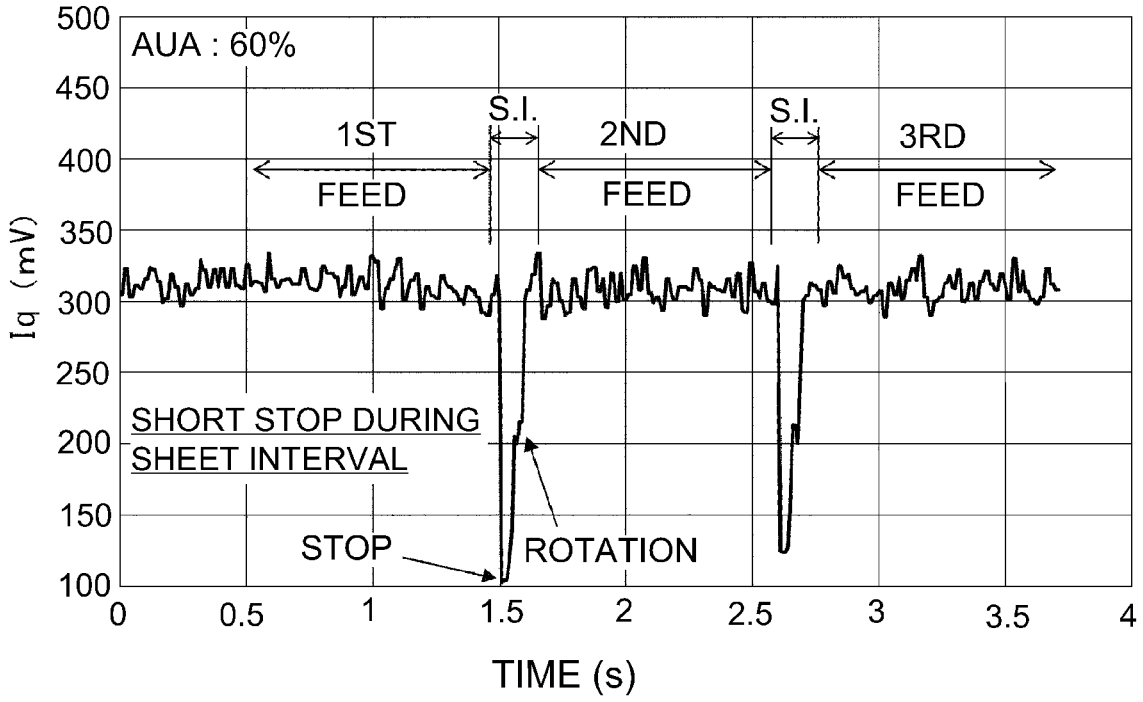
Figure 6C:
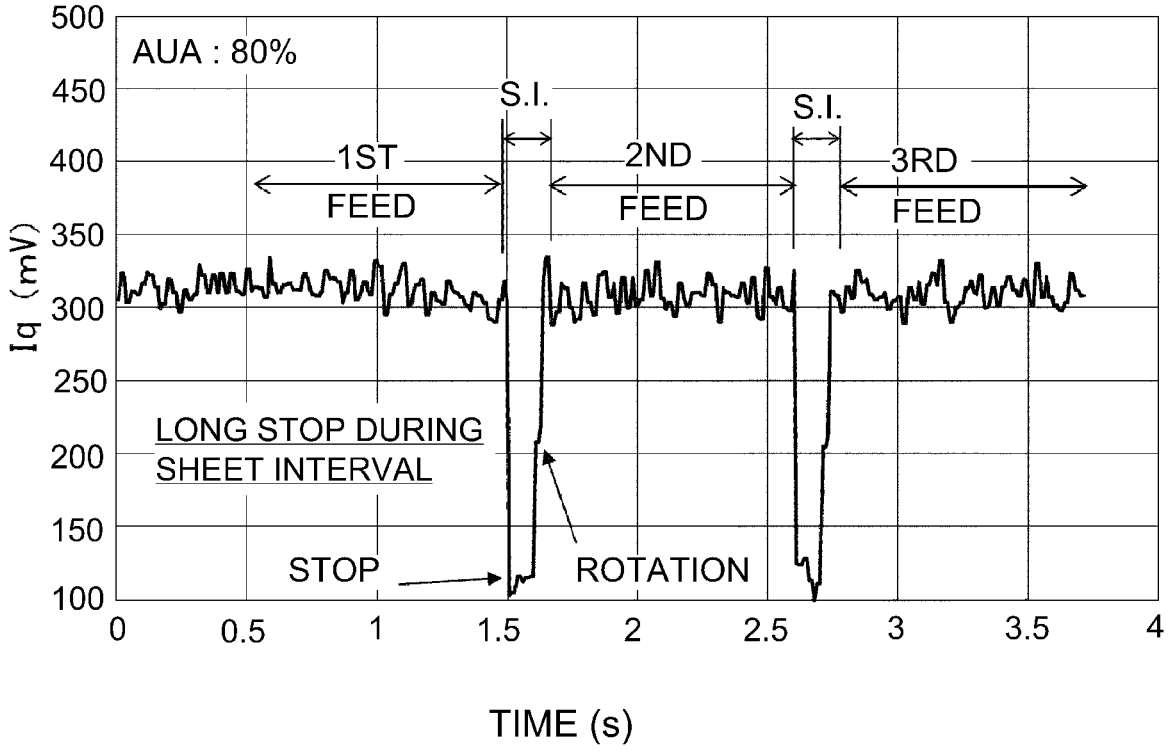

Each of FIGS. 6A to 6C shows a change (progression) of Iq when images are continuously printed on 3 pages of A3-size recording materials. Iq represents a value read as a voltage value from the CPU 40 via a digital/analog (D/A) converter.

A process speed of the image forming apparatus 100 is 300 mm/sec, and a distance (interval) between the recording material and the subsequent recording material is 30 mm. Accordingly, a time of passing of the recording material through the nip N when the A4-size recording material is fed in portrait orientation is about 1 sec, so that a time in which the subsequent recording material enters the nip N after passing of the preceding recording material through the nip N (hereafter, this time is referred to as a sheet interval time) is about 0.1 sec.

An environment in which the printing is performed and another condition are as follows. The printing is performed in an environment of room temperature (normal temperature) of 25° C. and a humidity of 80% relative humidity (RH) by using thin paper having a water content (percentage) of 9.0% and having low rigidity (basis weight: 70 g/m$^2$). Further, the printing was started from a state in which a surface temperature of the pressing roller 24 was lowered to the room temperature (25° C.) after a lapse of 1 hour or more from the last printing. A printing pattern is a halftone image (print ratio=80%), and a condition other than the accumulated use amount of the fixing device 20 is a condition such that the dew condensation slip is liable to occur.

FIGS. 6A, 6B, and 6C show Iq waveforms of the motor M when the accumulated use amount ("AUA") of the fixing device 20 reaches 50%, 60%, and 80%, respectively, of a lifetime of the fixing device 20.

The waveform of FIG. 6A shows a state in which a rotational speed of the film 23 is decelerated by 50% due to the dew condensation at the surface of the pressing roller 24 in an interval (sheet interval ("S.I.")) between a first sheet and a second sheet. By deceleration of the rotational speed of the film 23, the surface of the pressing roller 24 and the surface of the film 23 start a slip therebetween, and, therefore, a driving torque exerted on the metal core 24*a* of the pressing roller 24 decreases. Thus, an output value of Iq is less than an output value of Iq during sheet feeding.

In a state in which the rotational speed of the film 23 is decelerated by 50%, however, the rotational speed of the film 23 is restored to the original rotational speed at the instant when the second sheet enters the nip N, and, therefore, a heat-fixing process operation is performed with no problem.

Also as regards a third sheet, there is a tendency similar to the tendency of the second sheet.

In this embodiment, the state in which the rotational speed of the film 23 is decelerated by 50%, as described above, is discriminated as a sign of the dew condensation slip. In this state, the deceleration of the rotational speed of the film 23 occurs, but the image defect and the jam do not occur, so that the continuous printing is continued as it is.

FIG. 6B shows a state in which the rotation of the film 23 is stopped for a short time (about 0.03 sec) due to the dew condensation at the surface of the pressing roller 24 in the sheet interval between the first sheet and the second sheet, and then, the film 23 starts rotation thereof with a lapse of the time. This is because the sliding frictional force Fh between the film 23 and the heater 22 due to a further increase in accumulated use amount of the fixing device 20 than in the case of FIG. 6A. When the rotation of the film 23 stops, a degree of the slip between the film surface and the pressing roller surface is greater than that in the case of FIG. 6A, and, therefore, the driving torque exerted on the metal 24*a* of the pressing roller 24 further lowers, so that an output value of Iq further lowers.

Even in a state in which the rotation of the film 23 stops for the short time (about 0.03 sec) and then the film 23 starts rotation thereof with the lapse of the time as described above, the image defect and the jam do not occur, and, when the subsequent sheet enters the nip N, the normal printing operation is continued. Accordingly, also this state is discriminated as the sign of the dew condensation slip.

The waveform of FIG. 6C shows a state in which the rotation of the film 23 stops for a long time (about 0.1 sec) due to the dew condensation at the surface of the pressing roller 24 in the sheet interval between the first sheet and the second sheet and in which, even when the second sheet enters the nip N, the second sheet is not fed and causes a slack (loosening), and thus, the image defect occurs. In the state shown in FIG. 6C, the continuous sheet feeding is completed while the image defect occurs, but the jam occurs in some cases.

Therefore, in this embodiment, the lowering of the output of Iq is detected as the sign of the dew condensation slip as in the state of FIGS. 6A and 6B, and the dew condensation slip is avoided so that the state as shown in FIG. 6C does not occur. The CPU 40 discriminates that a dew condensation slip avoiding process is needed in a subsequent operation when a lowering amount of Iq and a lowering time of Iq, which are used as a fluctuation amount (lowering amount) of the driving torque in the above-described sheet interval are not less than thresholds acquired empirically in advance.

That is, the CPU 40 acquires a rotational speed lowering amount of the film 23 on the basis of a lowering amount of the driving torque T and acquires a rotational speed lowering time of the film 23 on the basis of a driving torque lowering time. Then, the CPU 40 rotational speed lowering amount is 50% or more (Iq: 150 mV or more) of the rotational speed lowering amount during the sheet feeding and the rotational speed lowering time is 40% or more (time: 0.04 sec or more) of the sheet interval time. Here, 50% of the rotational speed lowering amount during the sheet feeding is the threshold of the rotational speed lowering amount, and 40% of the sheet interval time is the threshold of the rotational speed lowering time.

In this embodiment, the CPU 40 discriminates that the dew condensation slip avoiding process is needed, by using both the lowering amount and the lowering time of the driving torque T, but may also make the discrimination using either one of the lowering amount and the lowering time of the driving torque T depending on the constitution of the fixing device 20. Further, the threshold used to differentiate between the slip sign and the occurrence of the slip is also determined empirically depending on the constitution of the fixing device 20 or the constitution of the image forming apparatus 100.

Further, in the above description, the state in which the rotation of the film 23 stops in the sheet interval is detected, but, when the amount of the dew condensation occurring at the surface of the pressing roller 24 further increases, a slip stat continues not only in the sheet interval, but also after the recording material P is fed to the nip N in some cases. Accordingly, as a detection state of the dew condensation slip, not only the sheet interval state but also the state of during feeding of the recording material P through the nip N may also be included. An example of that case will be described below.

The image forming apparatus 100 was continuously used in a period under a humidity condition such that the dew condensation did not occur, and during the period, use of the fixing device 20 also proceeded, and, thereafter, the image forming apparatus 100 was moved to a place different in installing environment from the place before the movement. In that case, when a humidity in the environment is greater than a humidity before the image forming apparatus 100 is moved, there is a possibility that the dew condensation slip occurs in the fixing device 20.

That is, in a case in which the fixing device 20 is installed in an environment in which the dew condensation slip is liable to occur after a remaining lifetime of the fixing device 20 becomes short, the slip state continued not only in the sheet interval, but also after the recording material P is fed to the nip N. In this case, it would be considered that the jam occurs due to the dew condensation slip, but the CPU 40 may only be required to cause the operation of the fixing device 20 to go to the following dew condensation slip avoiding process in subsequent printing.

Dew Condensation Slip Avoiding Process

The dew condensation slip avoiding process to be executed after the CPU 40 discriminates that the dew condensation slip avoiding process is needed will be described.

In order to form a state in which the dew condensation does not readily occur, there is a method in which a time, a so-called warm-up time, of pre-rotation (idling) of the pressing roller 24 and the film 23, performed before the heat-fixing process operation, is extended, and thus, the pressing roller surface is sufficiently warmed until the recording material P enters the nip N. This method is referred to as a "countermeasure by extension of pre-rotation time". In this method, a time required for the printing is greater than that for a normal printing operation by a pre-rotation extension time.

As another method of forming a state in which the surface of the pressing roller 24 is warmed to form the state in which the dew condensation does not readily occur, there is a method in which the above-described sheet interval time is extended and thus, the surface of the pressing roller 24 is warmed. For example, there is a method in which the sheet interval time is set at a rotation time corresponding to one full circumference of the pressing roller 24 and the dew condensation at the surface of the pressing roller 24 is caused to disappear and thus, the dew condensation slip is suppressed. This method is referred to as a "countermeasure by sheet interval extension". Also in this method, the time required for the printing is greater than that for the normal printing operation by a sheet interval extension time.

These "countermeasure by extension of pre-rotation time" and "countermeasure by sheet interval extension" may be performed singly and can also be performed in combination.

As described above, in either of the "countermeasure by extension of pre-rotation time" or the "countermeasure by sheet interval extension", for a user, a waiting time until an end of the printing increases.

Therefore, a method of decreasing the extension time to a minimum necessary level will be described below. In this embodiment, the case in which the method is applied to the "countermeasure by extension of pre-rotation time" will be described.

First, the CPU 40 discriminates that the dew condensation slip avoiding process is needed, at the time when the lowering amount and the lowering time of the driving torque T are not less than the thresholds. Next, a shortest time (0.2 sec in this embodiment) necessary to avoid the dew condensation slip is added to the pre-rotation time, extension of the pre-rotation time is performed from subsequent printing (which is not during a continuous print job shown in FIGS. 6A to 6C, but in a subsequent job). That is, the CPU 40 extends the time of the pre-rotation in which the pressing roller 24 is warmed while being rotated by the motor M before a sheet in the subsequent job reaches the nip N. Incidentally, in order to prevent the slip from occurring, during the job in which discrimination that the dew condensation slip avoiding process is needed is made, thresholds of a lowering amount and a lowering time of Iq for discriminating a sign of the dew condensation slip are set.

By performing the pre-rotation time extension, a surface temperature of the film 23 increases, so that a slip amount of the film 23 lowers. As a result, the dew condensation does not readily occur on the surface of the pressing roller 24, so that values of the lowering amount and the lowering time of the driving torque T become less than the thresholds again.

Also in subsequent printing, the CPU 40 continuously monitors the lowering amount and the lowering time of the driving torque T, and, in a period in which the lowering amount and the lowering time are less (lower) than the thresholds, the CPU 40 does not further extend the pre-rotation time.

Then, when the remaining lifetime of the device 20 becomes short and the lowering amount and the lowering time of the driving torque T are not less than the thresholds again, the CPU 40 discriminates that there is a need to further reinforce the avoiding process and further extends the pre-rotation time by 0.2 sec (0.4 sec in total). Thereafter, monitoring of the lowering amount and the lowering time of the driving torque T is similarly continued, and every time when the lowering amount and the lowering time are not less than the thresholds, the CPU 40 extends the pre-rotation time so that the surface temperature of the pressing roller 24 is increased stepwisely.

By performing the dew condensation slip avoiding process as described above, there is no need to add an unnecessary pre-rotation time extension, so that a waiting time for the user can be minimized. Incidentally, also to the "countermeasure by sheet interval extension", it is possible to apply the same method.

Effect of this Embodiment

In the following, an effect in the case in which the dew condensation slip avoiding process in this embodiment is applied will be described. Table 1 is a table showing a difference in pre-rotation extension time between this embodiment (Embodiment 1 ("EMB. 1") and a comparison example ("COMP. EX."). In Table 1, degrees of a change in pre-rotation extension time (sec) in different use conditions (the number of printed sheets in one job, a use environment of the image forming apparatus 100, and the accumulated use amount of the fixing device 20).

In Embodiment 1, the lowering amount and the lowering time of the driving torque T are monitored, and every time when the lowering amount and the lowering time are not less than the thresholds, the pre-rotation time before the heat-fixing process operation is increased by 0.2 sec.

In the comparison example, the pre-rotation time is extended by 0.5 sec depending on a different accumulated use amount (the number of printed sheets or the rotation time of the motor M). The reason why the extension time is 0.5 sec is that 0.5 sec is a necessary extension time to meet a case in which the dew condensation slip occurs earliest among various use conditions.

TABLE 1

| | Use Condition | | Percentage (%) of AUA*3 | | | | | |
|---|---|---|---|---|---|---|---|---|
| | NPS*1 | ENV*2 | 0 to 50 | 60 | 70 | 80 | 90 | 100 |
| EMB. 1 | 5 | NT | +0 s | +0.2 s | +0.2 s | +0.4 s | +0.4 s | +0.6 s |
| | 10 | NT | +0 s | +0 s | +0.2 s | +0.4 s | +0.6 s | +0.8 s |
| | 10 | LT | +0 s | +0.2 s | +0.4 s | +0.6 s | +0.8 s | +1.0 s |
| COMP. EX. | 5 | NT | +0 s | +0.5 s | +1.0 s | +1.5 s | +2.0 s | +2.5 s |
| | 10 | NT | +0 s | +0.5 s | +1.0 s | +1.5 s | +2.0 s | +2.5 s |
| | 10 | LT | +0 s | +0.5 s | +1.0 s | +1.5 s | +2.0 s | +2.5 s |

*1"NPS" is the number of print sheets (sheets) in one job.

*2"ENV" is the use environment of the image forming apparatus 100. "NT" is the normal temperature, and "RT" is the room temperature.

*3"AUA" is the accumulated use amount of the fixing device 20.

As is apparent from Table 1, in Embodiment 1, the pre-rotation time is extended in a case in which the lowering amount and the lowering time of the driving torque T are not less than the thresholds, and, therefore, the waiting (standby) time is extended in a minimum necessary amount. On the other hand, in the comparison example, the extension time is added in consideration of a possibility that the dew condensation slip occurs earliest, and, therefore, unnecessary extension of the waiting time is forced.

As described above, the image forming apparatus 100 of this embodiment includes the torque detecting means 42 for detecting the driving torque of the motor M, and, on the basis of the driving torque detected by the torque detecting means 42, the control means 40 controls a degree of temperature rise of the first rotatable member 24 up to immediately before the recording material P enters the nip N.

Case in which Difference Among Individual Fixing Devices are Taken into Consideration The driving torque T of the fixing device 20 has a difference among fixing devices due to a factor, such as a tolerance of each of component parts constituting the fixing device 20. For example, when spring constant of the pressing spring 27 shown in FIG. 3 varies within a range of the tolerance, a pressing force (pressure) changes, so that a width and a surface pressure of the fixing nip N change. As a result, the driving torque T of the motor M changes. In a case in which the pressing force is greater, the driving torque T becomes greater. Further, in a case in which the hardness of the elastic layer 24*b* of the pressing roller 24 is different due to the tolerance of the rubber hardness, the width and the surface pressure of the fixing nip N also change. As a result, the driving torque T shows a different value. A method of properly detecting occurrence timing of the dew condensation slip even in a case in which the driving torque T fluctuates with a factor, such as the component part tolerance during manufacturing of the fixing device 20, will be described.

Figure 10:
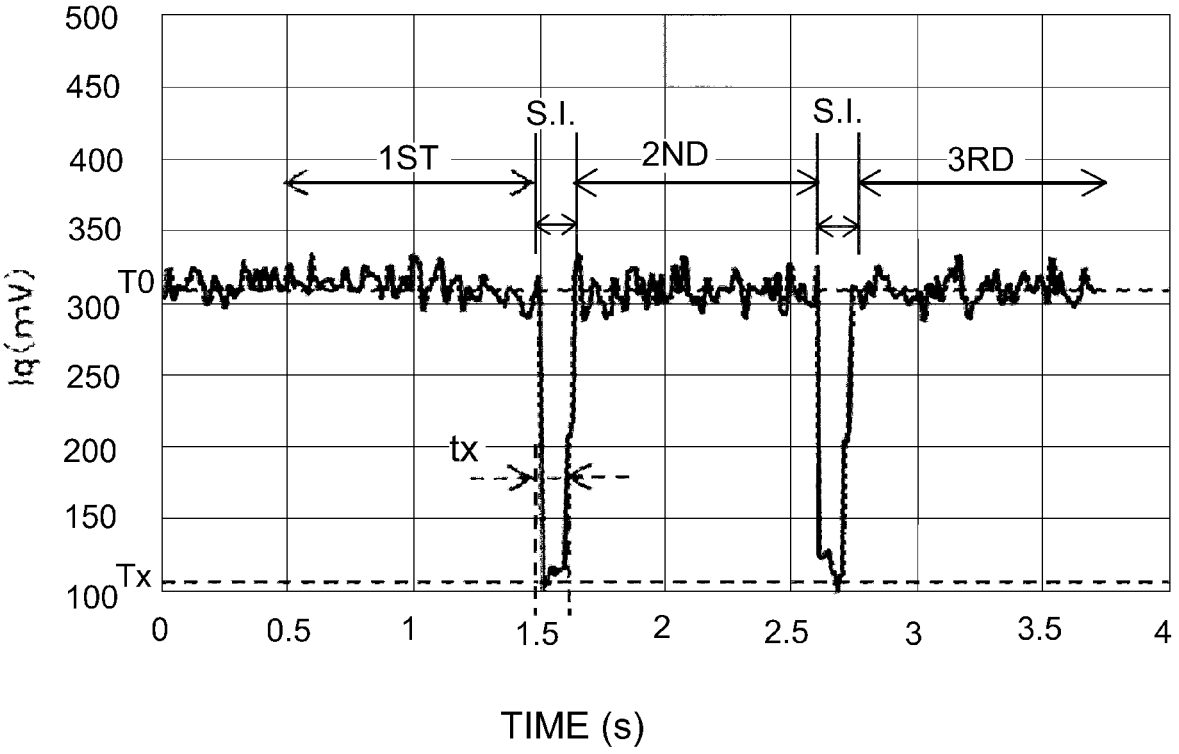
FIG. 10 is a schematic view showing a waveform of a current Iq of a motor M (change of driving torque T).

FIG. 10 shows a waveform (progression of the driving torque T) of Iq of the motor M. The driving torque T in a period (during sheet passing) in which the recording material P is fed through the fixing nip N is T0 (about 300 mV), and the driving torque T after the recording material P passes through the fixing nip N (during sheet interval) is Tx (about 110 mV). A period in which the driving torque T is Tx is tx. In a case in which the driving torque T of the device 20 has a difference among individual fixing devices due to the component part tolerance during manufacturing of the device 20, the driving torque T0 during the sheet passing shown in FIG. 10 is different for each of the devices 20. Further, in a case in which the driving torque T0 during the sheet passing is different, the driving torque T when the dew condensation slip occurs is different in some instances. Accordingly, also a threshold for the sign of the dew condensation slip may preferably be determined in consideration of the difference among individual fixing devices. The threshold may be determined on a case-by-case basis.

Case 1

Irrespective of a magnitude of the driving torque T during the sheet passing, in a case in which the driving torque Tx in the sheet interval when the dew condensation slip starts to occur is constant and unchanged, a unique value acquired empirically may only be determined as a discriminating threshold of a sign of an occurrence of the dew condensation slip.

Case 2

Even when the driving torque T0 changes, in a case in which the driving torque difference amount $\Delta T = T0 - Tx$ is constant and unchanged, the difference amount $\Delta T$ may only be determined as a discriminating threshold of slip sign.

Further, in a case in which a driving torque lowering rate r=Tx/T0 when the dew condensation slip starts to occur is constant, the lowering rate r may only be required to be used as the discriminating threshold of the slip sign.

Case 3

In a case in which depending on an initial characteristic of the driving torque T of the device 20, the torque Tx, the difference amount ΔT or the lowering rate r when the dew condensation slip starts to occur changes, there is a need to change the discriminating threshold of the slip sign depending on an associated case. In this case, there is a need to separately discriminate the initial characteristic of the driving torque T of the device 20 used. That is, there is a need to discriminate whether the driving torque T is large or small and the threshold is determined depending on a discrimination result. A specific method of discriminating the initial characteristic of the driving torque of the device 20 will be described later. The threshold may also be determined as a linear or non-linear relational expression for the initial characteristic of the driving torque. Or, a method in which an individual value determined empirically in advance is referred to as a table may also be employed. Further, a value used for discriminating the sign of the dew condensation slip is not limited to the torque Tx, the difference amount ΔT and the lowering rate r, which are described above.

Further, in a case in which when occurrence or non-occurrence of the dew condensation slip is discriminated, not only the change amount of the driving torque T in the sheet interval, but also the lowering time tx are related as described above, the threshold may only be required to be determined on the following case-by-case basis.

Case 4

Even when the driving torque T0 during changes, in a case in which the driving torque lowering time tx is constant and unchanged, a unique lowering time acquired empirically may only be used as a threshold when the dew condensation slip occurs.

Case 5

In a case in which the driving torque lowering time tx changes depending on an initial characteristic of the driving torque T of the device 20, there is a need to change the threshold depending on an associated characteristic. The change in threshold may also be determined as a linear or non-linear relational expression for the initial characteristic of the driving torque. Or, a method in which an individual value determined empirically in advance is referred to as a table has no problem.

In the following description, a method of discriminating the initial characteristic of the driving torque of the fixing device 20 will be described. A first method is such that during manufacturing of the image forming apparatus 100 or the fixing device 20, for each individual fixing device, the initial characteristic of the torque is measured using a tool or a measuring device and then, each of the fixing devices 20 is associated with intrinsic initial characteristic information. Further, the initial characteristic of the torque intrinsic to each of the fixing devices 20 may also be predicted from information on component parts of the fixing device 20 (for example, information on the hardness of the pressing roller 24, the pressing force by the pressing spring 27, the width of the nip N, or the like) as a value other than the actually measured value as described above. These actually measured initial characteristic information and predicted initial characteristic information of the torque can be used by being stored in a storing means provided in the fixing device 20 or the image forming apparatus 100 including the fixing device 20. As the storing means, a memory, such as non-volatile random access memory (NVRAM), and an integrated chip (IC) tag, a bar code, and the like, can be used.

A second method is such that the initial characteristic of the torque is discriminated from the driving torque T of the motor M measured during the operation of the image forming apparatus 100. In a case in which the driving torque T is measured using the image forming apparatus 100, when measurement is performed at some timings as described above, a torque characteristic with high reliability can be obtained.

After the image forming apparatus 100 is installed, the user first turns on a main switch of the apparatus and can perform measurement at timing (during actuation of the heater 22 of the fixing device 20) of performing initialization of the apparatus. Further, in order to perform stable measurement, the measurement may also be carried out after waiting stabilization of the driving torque T while keeping an on-state of the heater 22 for a predetermined time. Further, as a timing other than the timing of turning on of the main switch, the measurement can be performed in a period (during post-rotation after the passing of the recording material or during extension of a post-rotation time) in which the fixing device 20 is sufficiently warmed after the printing operation. Further, these torque characteristics may be determined by a single measured value or may also be determined by an average of a plurality of accumulated measurement data. Incidentally, the timing of measuring the initial characteristic of the torque is not limited to the above-described timings but may also be timing during the passing of the recording material, and a like timing, if an individual torque characteristic of the fixing device 20 can be discriminated.

Environment Temperature

Further, depending on an install environment of the image forming apparatus 100, the driving torque T of the fixing device 20 changes. This is because viscosity of a lubricant, such as heat-resistant grease interposed between the heater 22 and the film 23, changes. There is a tendency that the driving torque becomes greater in a lower temperature environment. Further, the driving torque T also changes depending on ease of dew condensation due to the temperature of the fixing device or an ambient temperature.

Accordingly, the threshold of the torque fluctuation amount for predicting the occurrence of the above-described dew condensation slip may preferably be changed depending on the install environment of the image forming apparatus 100. In a case in which the image forming apparatus 100 includes an environment sensor capable of detecting the environment temperature or humidity, depending on a detection result thereof, the threshold of the driving torque fluctuation amount can be changed. Alternatively, in a case in which a resistance value of the transfer member 5 is predicted from a current value when a voltage is applied to the transfer member 5 and then the environment temperature or humidity can be predicted from the predicted resistance value, the threshold of the driving torque fluctuation amount may also be changed on the basis of these pieces of information.

Embodiment 2

Figure 7:
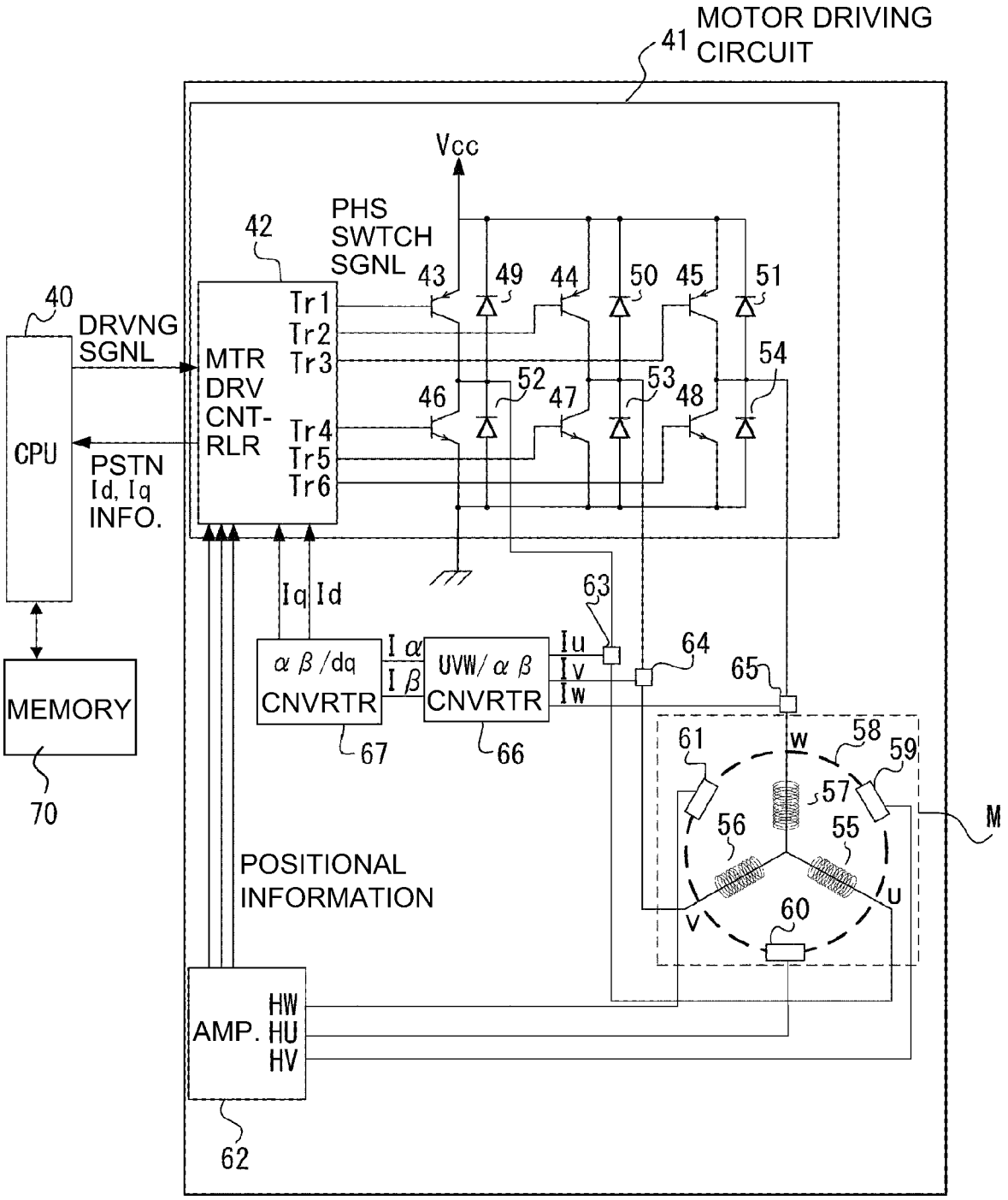
FIG. 7 is a block diagram showing a relationship among a motor, a motor driving circuit portion, a UVW/αβ coordinate transformation portion, an aβ/dq coordinate transformation portion, an amplifier, a CPU, and a memory in an image forming apparatus according to Embodiment 2.

An image forming apparatus 100 according to Embodiment 2 will be described with reference to FIG. 7. The image forming apparatus 100 in this embodiment includes a memory (RAM) 70 as a storing means for storing (accumulating) slip sign data. FIG. 7 is a block diagram showing a relationship among a motor M, the member drive circuit portion 41, a UVW/αβ coordinate transformation portion 66, an aβ/dq coordinate transformation portion 67, an amplifier 62, a CPU 40, and the memory 70.

The image forming apparatus 100 in this embodiment accumulates and stores, in the memory 70, a plurality of conditions set in advance for printing and associated with the slip sign as the slip sign data. Then, on the basis of the slip sign data, a tendency of an occurrence of a slip is managed (analyzed), and then, on the basis of the tendency, the dew condensation slip avoiding process for extending a rotation time of the motor M is carried out.

In the image forming apparatus 100 in this embodiment, a case in which the dew condensation slip avoiding process is carried out can be restricted effectively, so that the extension time added to the time of the printing operation can be further reduced. Particularly, an occurrence rate of the dew condensation slip highly correlates with water content (amount) contained in the recording material. In a case in which the image forming apparatus 100 is provided with a humidity sensor, the water content of the recording material can be easily estimated, and, therefore, the condition is readily restricted depending on the humidity. To the image forming apparatus including no humidity sensor, however, the dew condensation slip avoiding process in this embodiment is applied, whereby restriction of the dew condensation slip occurrence condition becomes easy.

FIGS. 8A to 8D are graphs showing the cases of accumulation of the slip sign data for a plurality of conditions consisting of the day of a week, a time (o'clock), a plurality of cassettes, and a print ratio, respectively. FIGS. 8A to 8D show period (interval) data of 0% to 50% in terms of the accumulated use amount of the fixing device 20 with respect to a lifetime of the fixing device 20, and the graphs each show accumulated slip sign data in a range in which the driving torque fluctuation amount is less than the threshold.

Figure 8A:
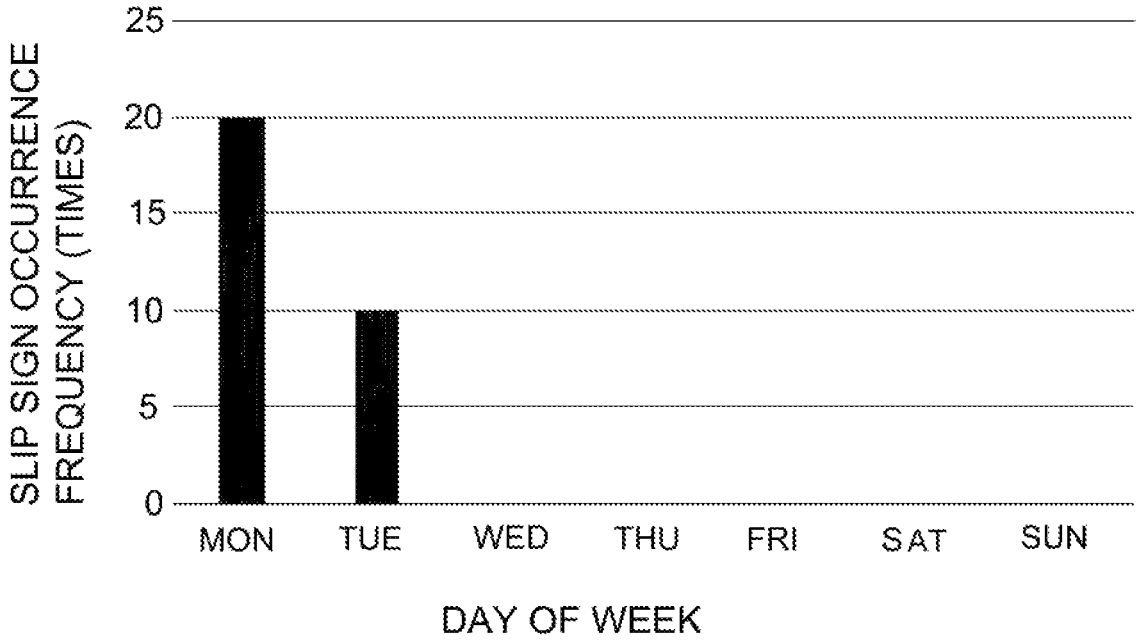
FIG. 8A is a graph in a case in which slip sign data is accumulated by a day of a week.

Referring to FIG. 8A, a case in which an occurrence frequency of the slip sign is associated with the day of a week and is accumulated as the slip sign data will be described. In a case in which the slip sign occurs only on Monday and Tuesday, even when the occurrence of the slip sign is a predetermined threshold or more, the dew condensation slip avoiding process may only be required to be performed only on Monday and Tuesday. An air conditioner is turned off on weekends, and, therefore the recording materials are liable to take up moisture due to indoor moisture. The recording material water content is high until the air conditioner sufficiently works on first and second weekdays. For that reason, it would be considered that the slip sign occurs on Monday and Tuesday.

Figure 8B:
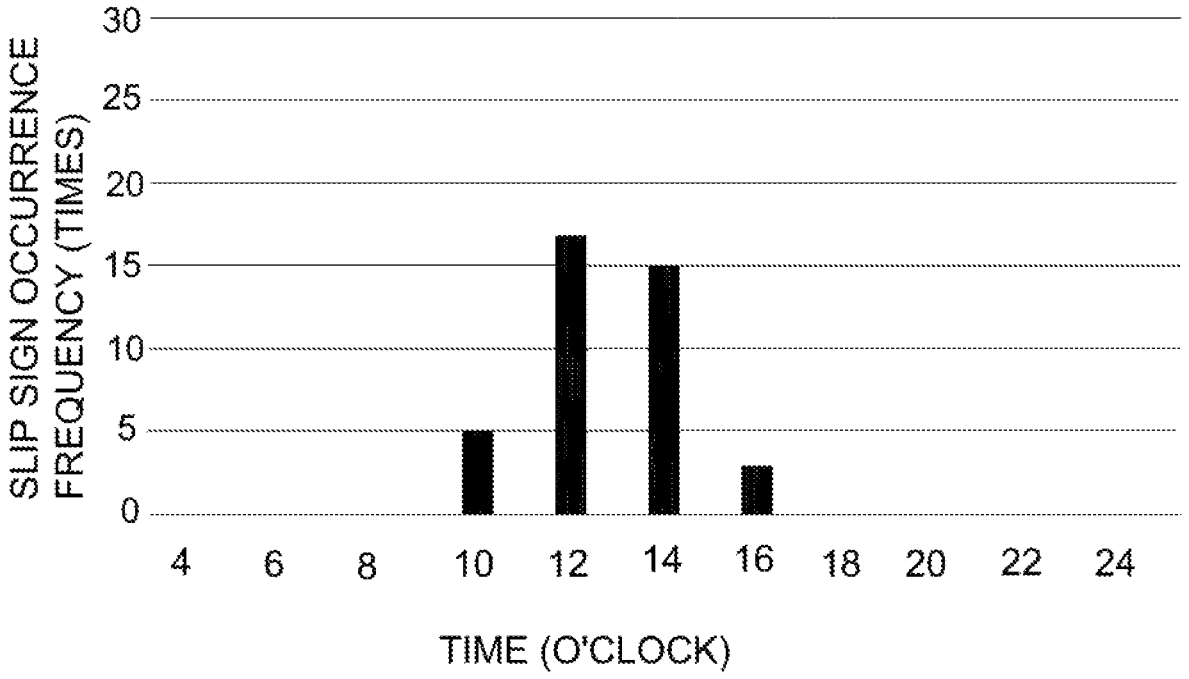
FIG. 8B is a graph in a case in which slip sign data is accumulated by a time.

Referring to FIG. 8B, a case in which the occurrence frequency of the slip sign is associated with the time (o'clock) and is accumulated as the slip sign data will be described. The slip sign appears between 10:00 and 16:00. In such a case, the dew condensation slip avoiding process may only be required to be performed in the time period (zone) restrictively.

The cases of FIGS. 8A and 8B show result of analysis of a tendency of the occurrence of the slip with respect to a time axis, such as the day of the week and the time (o'clock). The slip sign data may, however, also be accumulated on one-month basis or on one-year basis, and a tendency thereof may also be used. Further, discrimination of the tendency is not limited to discrimination based on a single tendency, but an occurrence tendency of the slip may also be derived from a plurality of conditions, for example, "only during the morning of Friday in February and March".

Figure 8C:
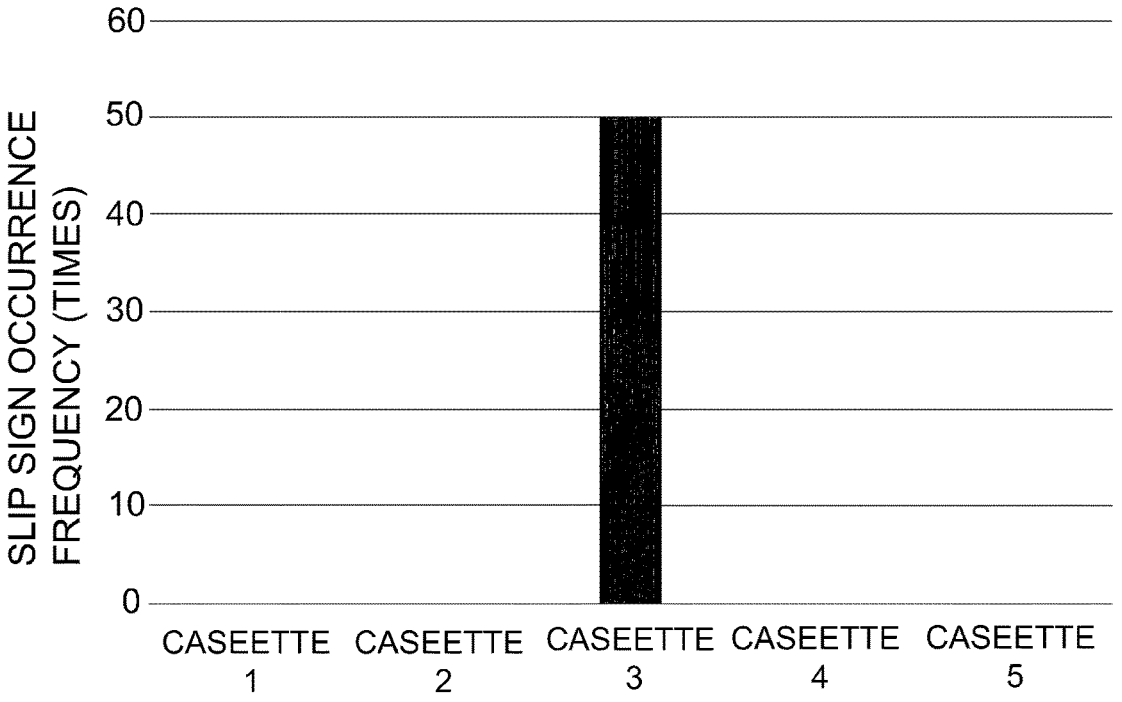
FIG. 8C is a graph in a case in which slip sign data is accumulated by a cassette of a plurality of cassettes.

As another example, in a case in which, as shown in FIG. 8C, the image forming apparatus 100 includes a plurality of cassettes and recording materials of different kinds are accommodated in the cassette, respectively, the occurrence frequency of the slip sign is associated with each of the cassettes and may only be required to be accumulated as the slip sign data. On the basis of the accumulated slip sign data, the dew condensation slip avoiding process may only be required to be performed.

Figure 8D:
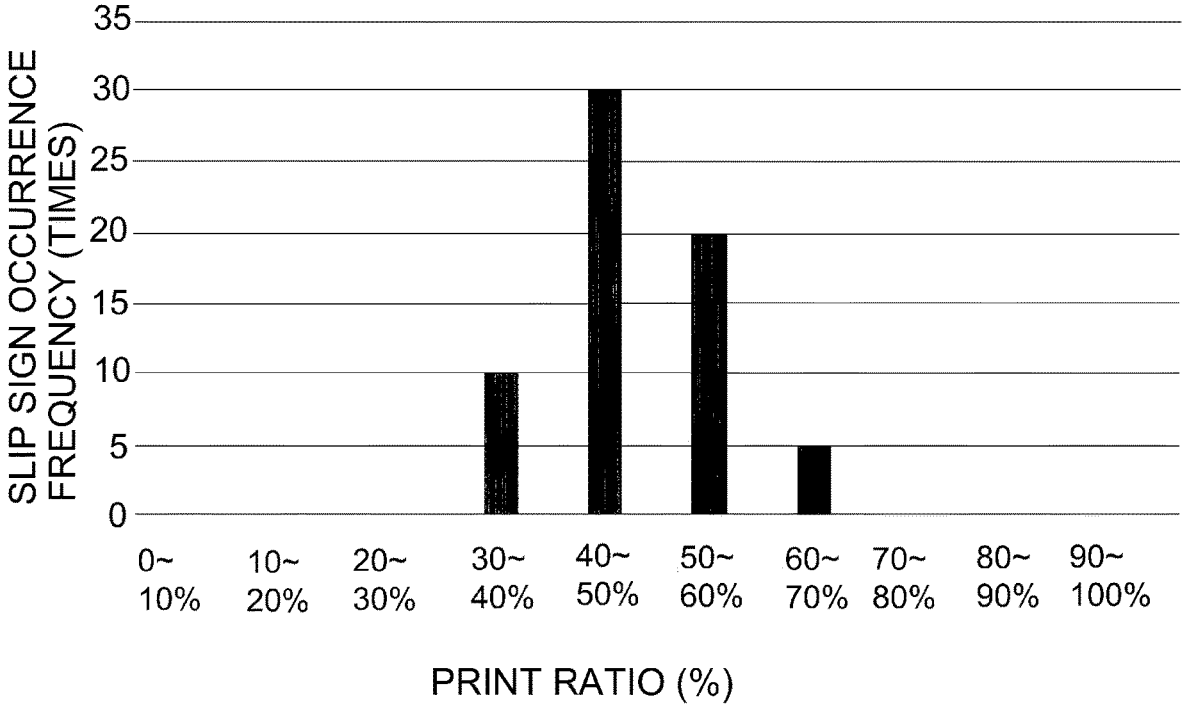
FIG. 8D is a graph in a case in which slip sign data is accumulated by a print ratio.

FIG. 8D shows a result of accumulation of, as the slip sign data, the occurrence frequency of the slip sign associated with a print ratio of an image. In a normal state, an image with a high print ratio increases in discharge amount of water vapor toward the pressing roller 24 side, and, therefore, is disadvantageous in occurrence of the dew condensation, but in the case of this user, the slip sign occurrence frequency is greatest for an image with a medium print ratio (40% to 50%). For example, when there is a tendency such that the kind of the recording material used by the user is the kind such as pre-print paper, and, from a combination thereof with an image pattern, the dew condensation is liable to occur at the medium print ratio, the dew condensation slip avoiding process may only be required to be performed in accordance with the tendency.

The parameters associated with the slip sign occurrence frequency are not limited to the day of the week, the time (o'clock), the plurality of cassettes, and the print ratio for the printing as described above, and may also be the month and day, an environment temperature, an environment humidity, the kind of the recording material, and a print mode.

Effect of this Embodiment

As described above, the slip sign data is accumulated on the basis of the various parameters, so that the tendency of the occurrence of the slip depending on the using condition of the image forming apparatus 100 can be managed. On the basis of this tendency, a condition in which it would be considered that the dew condensation slip occurs is narrowed, so that a frequency of "countermeasure by extension of pre-rotation time" and "countermeasure by sheet interval extension" can be remarkably decreased and thus, a print waiting time can be reduced to a minimum necessary level.

Other Embodiment

The image forming apparatus according to the present invention is not limited to the image forming apparatus for forming a monochromatic image, and may also be an image forming apparatus for forming a full-color image.

Figure 9:
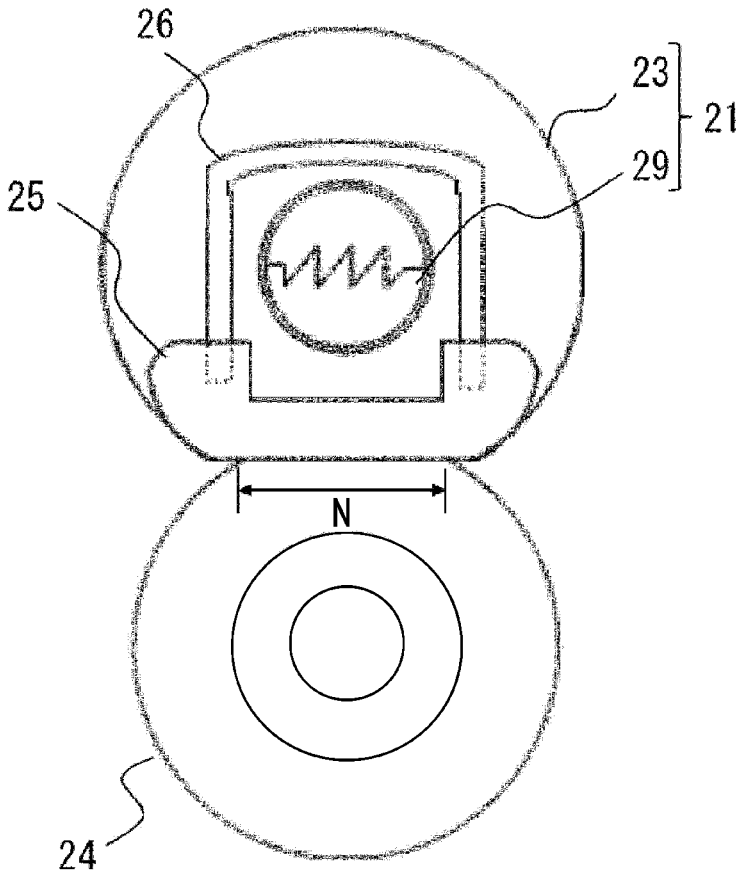
FIG. 9 is a sectional view showing a general structure of a fixing device in another embodiment.

The fixing device 20 may also be a fixing device of a film heating type as shown in FIG. 9. A fixing device 20 shown in FIG. 9 has the same constitution as the constitution of the fixing device 20 in FIG. 2, except that a halogen heater 29 is used in place of the heater 22 in FIG. 2.

The fixing device 20 may also be a fixing device of a type in which the base layer of the film 23 directly generates heat by energization and a fixing device of an electromagnetic induction heat generation type.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

What is claimed is:

1. An image forming apparatus comprising:

an image forming portion configured to form an image on a recording material;

a fixing portion including a first rotatable member and a second rotatable member, rotatable by rotation of said first rotatable member, and in contact with said first rotatable member, said fixing portion being configured to fix the image on the recording material by heating the image while nipping and feeding the recording material, on which the image is formed, at a nip formed between said first rotatable member and said second rotatable member;

a motor configured to drive said first rotatable member;

torque detecting means configured to detect a driving torque of said motor; and a controller, wherein, on the basis of the driving torque detected by said torque detecting means, said controller controls a degree of temperature rise of said first rotatable member immediately before the recording material enters the nip.

2. The image forming apparatus according to claim 1, wherein said controller controls the degree of temperature rise of said first rotatable member by setting a rotation time during warm up of said first rotatable member on the basis of the driving torque detected by said torque detecting means.

3. The image forming apparatus according to claim 2, wherein said controller compares the driving torque detected by said torque detecting means with a threshold and sets the rotation time during the warm up.

4. The image forming apparatus according to claim 3, wherein, when the driving torque detected by said torque detecting means is less than the threshold, said controller extends a rotation time during warm up for a subsequent print job, and makes a temperature of said first rotatable member greater than a temperature of said first rotatable member when the rotation time is not extended.

5. The image forming apparatus according to claim 3, wherein, when a lowering amount of the driving torque detected by said torque detecting means is greater than the threshold, said controller extends a rotation time during warm up for a subsequent print job, and makes a temperature of said first rotatable member greater than a temperature of said first rotatable member when the rotation time is not extended.

6. The image forming apparatus according to claim 3, wherein the threshold is different depending on an initial characteristic of the driving torque.

7. The image forming apparatus according to claim 1, wherein said controller controls the degree of the temperature rise of said first rotatable member by setting a sheet interval during continuous printing on the basis of the driving torque detected by said torque detecting means.

8. The image forming apparatus according to claim 7, wherein said controller compares the driving torque detected by said torque detecting means with a threshold and sets a sheet interval.

9. The image forming apparatus according to claim 8, wherein, when the driving torque detected by said torque detecting means is less than the threshold, said controller extends the sheet interval and makes a temperature of said first rotatable member greater than a temperature of said first rotatable member when the sheet interval is not extended.

10. The image forming apparatus according to claim 8, wherein, when a lowering amount of the driving torque detected by said torque detecting means is greater than the threshold, said controller extends the sheet interval and makes a temperature of said first rotatable member greater than a temperature of said first rotatable member when the sheet interval is not extended.

11. The image forming apparatus according to claim 8, wherein the threshold is different depending on an initial characteristic of the driving torque.

12. The image forming apparatus according to claim 11, wherein the initial characteristic of the driving torque is at least one of torque data individually measured during manufacturing of said image forming apparatus and component part data of individual component parts incorporated in said fixing portion during the manufacturing of said image forming apparatus.

13. The image forming apparatus according to claim 12, further comprising storing means configured to store the torque data.

14. The image forming apparatus according to claim 11, wherein the initial characteristic of the driving torque is a detection result of the driving torque detected by said torque detecting means at a predetermined timing during an operation of said image forming apparatus.

15. The image forming apparatus according to claim 11, further comprising one of (a) an environment detecting means configured to detect at least one of a temperature, and (ii) a humidity of an environment in which said image forming apparatus is installed, and (b) environment predicting means configured to predict the environment, wherein the threshold is different depending on one of a detection result of said environment detecting means, in a case in which said image forming apparatus comprises said environment detecting means, and a prediction result of said environment predicting means, in a case in which said image forming apparatus comprises said environment predicting means.

16. The image forming apparatus according to claim 1, wherein said second rotatable member is a cylindrical film.

17. The image forming apparatus according to claim 16, wherein said fixing portion includes a heater configured to heat said film.

18. The image forming apparatus according to claim 17, wherein said heater contacts an inner surface of said film and forms the nip via said film in cooperation with said first rotatable member.

* * * * *